United States Patent [19]

Okamoto et al.

[11] 4,333,040

[45] Jun. 1, 1982

[54] GAS DISCHARGE DISPLAY DEVICE

[75] Inventors: Yukio Okamoto, Hachioji; Eisuke Mitani, Tokorozawa; Tadao Okabe, Hachioji; Atsushi Sumioka, Kokubunji, all of Japan

[73] Assignee: Hitachi, Ltd., Tokyo, Japan

[21] Appl. No.: 49,872

[22] Filed: Jun. 19, 1979

[30] Foreign Application Priority Data

Jun. 19, 1978 [JP] Japan ..... 53-83849[U]

[51] Int. Cl.[3] ..... H01J 61/06

[52] U.S. Cl. ..... 315/169.2; 313/494; 340/768

[58] Field of Search ..... 315/169.2, 169.4, 59; 313/217, 494, 491; 340/753, 754, 768

[56] References Cited

U.S. PATENT DOCUMENTS

| | | | |
|---|---|---|---|
| 3,675,065 | 7/1972 | Warne | 315/169.4 |
| 3,716,742 | 2/1973 | Nakayama et al. | 315/169.4 |
| 3,735,183 | 5/1973 | Walters | 313/188 |
| 3,775,764 | 11/1973 | Gaur | 340/768 |
| 3,872,346 | 3/1975 | Kunii | 315/169.4 |
| 3,873,870 | 3/1975 | Fukushima et al. | 313/217 |
| 3,891,883 | 6/1975 | Ahmed | 313/217 |
| 3,898,515 | 8/1975 | Andoh et al. | 315/169.2 |
| 3,917,972 | 11/1975 | Yanagisawa et al. | 313/217 |
| 3,964,050 | 6/1976 | Mayer | 340/768 |
| 3,984,718 | 10/1976 | Fein et al. | 315/169.4 |
| 4,128,787 | 12/1978 | Bigelow | 315/169.4 |

FOREIGN PATENT DOCUMENTS

| | | | |
|---|---|---|---|
| 1279406 | 6/1972 | United Kingdom | 315/169.2 |

*Primary Examiner*—Eugene La Roche
*Attorney, Agent, or Firm*—Craig & Antonelli

[57] ABSTRACT

A gas discharge display device comprising alternately disposed anodes and cathodes, wherein the anodes and the cathodes are interconnected respectively in multi-phase connections whereby a bar-graph display can be effected by means of a self-scanning function.

6 Claims, 4 Drawing Figures

GAS DISCHARGE DISPLAY DEVICE

This invention relates to a display device utilizing gas discharge, and more particularly to a gas discharge display device for displaying a bar-graph.

One conventional example of an analog display device is known as a bar-graph display panel. Such panels using a plasma display, fluorescent display tubes, light emitting diodes, liquid crystal display, or electroluminescence have been developed. This kind of electronic bar-graph display provides the merits of both digital and analog displays and therefore finds wide applications in the fields of measurement, medical instruments, audio instruments, and car-mounted display devices.

FIG. 1 shows in an exploded view the structure of a conventional and typical bar-graph display device using plasma display. As shown in the figure, the device comprises a substrate 1, a transparent face plate 9 and a spacer 8 having a discharge space 7. The substrate 1 has thereon a multiplicity of cathode electrodes ($K_1$, $K_2$, . . . , $K_n$) 2, a reset electrode (R) 4, a keep-alive electrode 5, terminals 20, 21, 22, 40 and 50 for applying drive voltages to these electrodes, and leads 200, 201 and 202 for the multi-phase (three-phase in the case shown) connection of the cathodes electrodes. The face plate 9 has thereon an anode 3 of transparent conductive film (for example, tin oxide), a second keep-alive electrode 5', terminals 30 and 50' for the anode 3 and the electrode 5', and leads 301 etc. The substrate 1 and the face plate 9 are laminated with the spacer 8 sandwiched therebetween. The side portions of the lamination structure is sealed with frit glass material.

The thus constructed device has a so-called self-scanning function and therefore the number of drive circuits for the cathodes, that is, the number of terminals for the cathodes is independent of that of the used cathodes. For example, in the case of a three-phase connection, the three terminals (20, 21, 22) are used for the cathodes and the four (30, 50', 40, 50) for the other electrodes. Thus, only the seven terminals suffice for a single bar-graph, as shown in FIG. 1.

Although this constitution has an advantage of leading to an economy of circuit elements, it suffers from the following demerits. (1) Since the cathodes 2 and the anode 3 are formed on different members (i.e. the substrate 1 and the face plate 9) respectively, and since the conditions for the formation of the cathodes are different from those for the formation of the anode, then the number of steps of the production process is great and the exact registration of the electrodes is difficult. (2) When it is desired to provide a color display, there is no room for the phosphor material to be applied. (3) Since the terminals are provided on the different members 1 and 9, the interconnections of the terminals are complicated so that the reliability of the circuit is not satisfactorily high.

Accordingly, one object of this invention is to provide a bar-graph display device which can be constructed through a reduced number of process steps.

Another object of this invention is to provide a bar-graph display device which has a high reliability and can provide a multi-color display.

Still another object of this invention is to provide a bar-graph display device which has a simple structure and a self-scanning function.

According to one aspect of this invention, there is provided a gas discharge display device comprising a plurality of anodes on the same substrate spaced from each other, a plurality of cathodes disposed between said anodes and in a relationship spaced therefrom, first means for multi-phase connecting said anodes, and second means for multi-phase connecting said cathodes, whereby discharge produced between a selected one of said cathodes and a selected one of anodes is self-scanned in accordance with the multi-phase connections.

According to another aspect of this invention, there is provided a gas discharge display device comprising first and second dielectric plates at least one of which is transparent, a plurality of anodes on said first plate spaced from each other, a plurality of cathodes on said first plate disposed between said anodes and in a relationship spaced therefrom, first means for multi-phase connecting said anodes, second means for multi-phase connecting said cathodes, insulating means inserted between said first and second plates to define a discharge space in which discharge between said anodes and cathodes is established, and discharge gas hermetically contained in said discharge space, wherein the discharge is self-scanned.

According to still another aspect of this invention, there is provided a gas discharge display device comprising first and second dielectric plates at least one of which is transparent, a plurality of cathodes on said first substrate spaced from each other, a plurality of anodes on said second substrate spaced from said cathodes, first means for multi-phase connecting said plural cathodes, second means for multi-phase connecting said anodes, insulating means inserted between said first and second plates to define a discharge space in which discharge between said anodes and cathodes is established, and discharge gas hermetically contained in said discharge space, wherein the discharge is self-scanned.

This invention will be apparent in conjunction with the accompanying drawings, in which.

Figure 2:
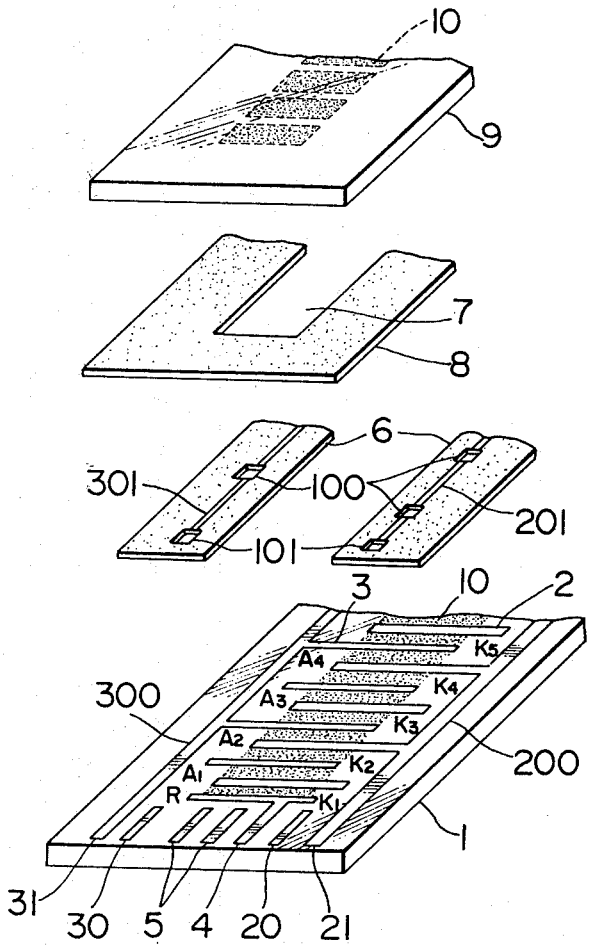
FIG. 2 shows in an exploded view a bar-graph display device as an embodiment of this invention.

Referring to FIG. 2 showing a bar-graph display device as an embodiment of this invention, there will be apparent a production process therefor. First, cathodes 2($K_1$, $K_2$, . . . , $K_n$), anodes 3($A_1$, $A_2$, . . . , $A_n$), a reset electrode 4(R), a pair of keep-alive electrodes 5, cathode terminals 20 and 21, anode terminals 30 and 31, a two-phase cathode interconnection 200 for connecting every other cathode ($K_2$, $K_4$, . . . in the case shown) with the cathode terminal 21, and a two-phase anode interconnection 300 for connecting every other anode ($A_2$, $A_4$, . . . in the case shown) with the anode terminal 31 are simultaneously formed on the same surface of a substrate 1 of a dielectric such as glass through, for example, the thick-film screening or plating technique with air fireable nickel paste or composition.

A dielectric layer 6 is thereafter formed on the surface of the resultant substrate 1 through, for example, the printing and firing of glass paste, except at least an active display area defined by the anodes 3 and the cathodes 2, a portion of each of the terminals 20, 21, 30 and 31, portions 100 of the not yet connected cathodes ($K_1$, $K_3$, . . . ) and the not yet connected anodes ($A_1$, $A_3$, . . . ) to be connected with two-phase interconnections respectively, and portions 101 of the terminals 20 and 30 to be connected with the two-phase interconnections respectively. Then, the two-phase cathode interconnection 201 and the two-phase anode interconnection 301 are formed by the printing and firing of Ni paste and the connections through the above portions 100 and 101 are performed with, for example, Ag-paste.

A plate 8 (of, for example, dielectric) to define a discharge space 7 having a desired shape is provided on the resulting substrate 1. The plate 8 may be formed by the well known thick-film screening technique. Finally, a face plate 9 of, for example, transparent glass is placed on the plate 8 and the hermetical sealing is effected to contain high vacuum in.

At least one of the opposite surfaces of the face plate 9, except that portion thereof which is used as a display area having a desired shape, may be provided with an opaque and non-reflective coating or black surrounding matrix-shaped material.

Phosphors 10 (for vacuum ultraviolet rays, green light, red light, yellow light, etc.) for a multi-color display may be applied in a desired pattern on at least a surface portion of the face plate 9 or the substrate 1 (between the cathodes 2 and anodes 3) facing the discharge space 7. The discharge space 7 is filled with one of rare or inert gases Xe, Kr, Ne, He, etc. or the mixture of some of them, with or without a small amount of Hg.

With this process of fabrication, the following merits can be enjoyed. (1) Since all the electrodes can be formed simultaneously on the same surface, the number of the fabrication process steps can be reduced and moreover the precision in working can also be improved. (2) Since phosphors can easily find the room to be deposited in, a multi-color display can be effected. (3) The general assemblage can be facilitated. (4) Since all the terminals are formed on the same plane, the connection thereof with a connector is facilitated and moreover reliability is improved.

The above embodiment is useful for the case where positive pulses are applied to the reset electrode 4, that is, the reset electrode serves as the anode, but it should be understood that quite similar constitution can be applied to the case where negative pulses are used. Namely, in the latter case, the roles of the cathodes and anodes are interchanged, that is, the electrode arrangement $R\text{-}K_1\text{-}A_1\text{-}K_2\text{-}\ldots$ shown in FIG. 2 is replaced by an arrangement $R\text{-}A_1\text{-}K_1\text{-}A_2\text{-}\ldots$. Further, though the face plate 9 has been used as a viewing face, the substrate 1 may be used for the same purpose when the substrate 1 is made of transparent material. Moreover, in the embodiment shown in FIG. 2, the display area has been formed by the linearly arranged anodes and linearly arranged cathodes, but the anode arrangement and the cathode arrangement may be arbitrary, for example, circular.

Now, the operation of the above-described display device will be explained. Since the cathodes and the anodes are respectively connected by the two-phase cathode and anode interconnections 200 and 300, the discharge produced between the reset electrode 4(R) and the cathode $K_1$ is shifted to any desired position (that is, self-scanning) in response to input signals (voltage pulse signals) applied to the cathode terminals 20 and 21 and to the anode terminals 30 and 31. For example, the shift mode of the discharge is such as $(R\text{-}K_1)\rightarrow(K_1\text{-}A_1)\rightarrow(A_1\text{-}K_2)\rightarrow(K_2\text{-}A_2)\rightarrow(A_2\text{-}K_3)\rightarrow\ldots$, $(R\text{-}K_1)\rightarrow(K_1\text{-}A_1)\rightarrow(K_2\text{-}A_2)\rightarrow(K_3\text{-}A_3)\rightarrow\ldots$, or $(R\text{-}K_1)\rightarrow(A_1\text{-}K_2)\rightarrow(A_2\text{-}K_3)\rightarrow\ldots$. Ultraviolet radiation generated due to the gas discharge excites the phosphors into the emission of their inherent lights for the display of information. When the phosphors are not used, the luminescence due to the gas discharge itself may be directly used.

In the above-described operation, the number of the used terminals is independent of both the number of the cathodes and the number of the anodes, and only the seven terminals, i.e. two terminals for the cathodes, two for the anodes, one for the reset electrode and two for the keep-alive electrodes, can suffice for the purpose. Thus, the device can be operated with the reduced number of terminals and hence drive circuits, in comparison with a self-scanning drive with more than four phases. This leads to the reduction of production cost.

Figure 1:
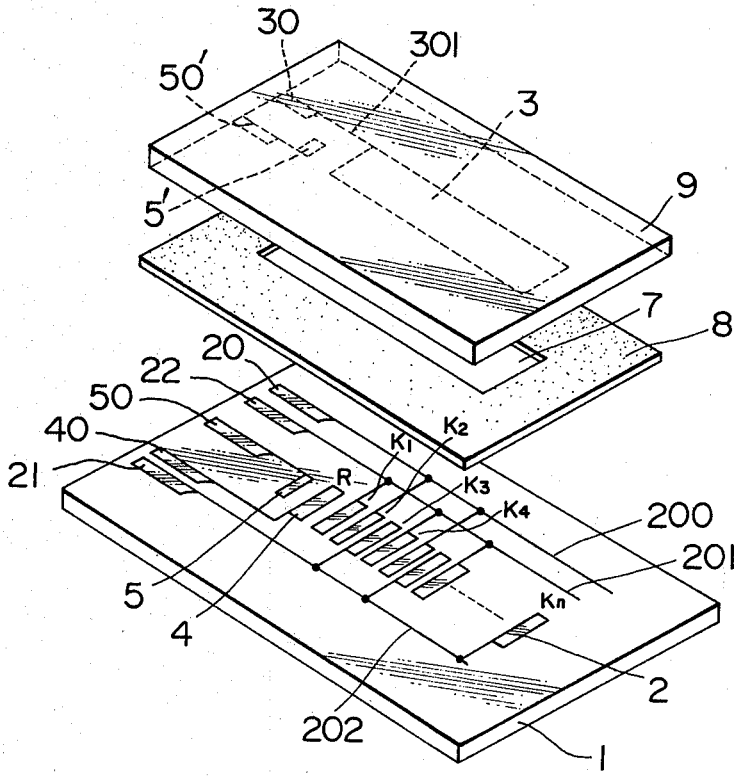
FIG. 1 PRIOR ART
FIG. 1 shows in an exploded view a conventional bar-graph display device.

Moreover, only four drive circuits are used in not only the conventional single-phase anode and three-phase cathode arrangement shown in FIG. 1 (where the smallest number of drive circuits are used), but also the embodiment of this invention shown in FIG. 2 with the two-phase anode and two-phase cathode arrangement. Though the same number of the drive circuits are used in both the conventional example and the embodiment of this invention shown in FIG. 2, the latter has an operating margin greater than the former and hence can stably operate. The reason is that the degree of ionization coupling is smaller in this embodiment than in the conventional example since the distance from the cathode at which discharge is taking place to the next adjacent cathode to which the same drive voltage pulse is being applied is greater in this embodiment than the conventional example.

Figure 3:
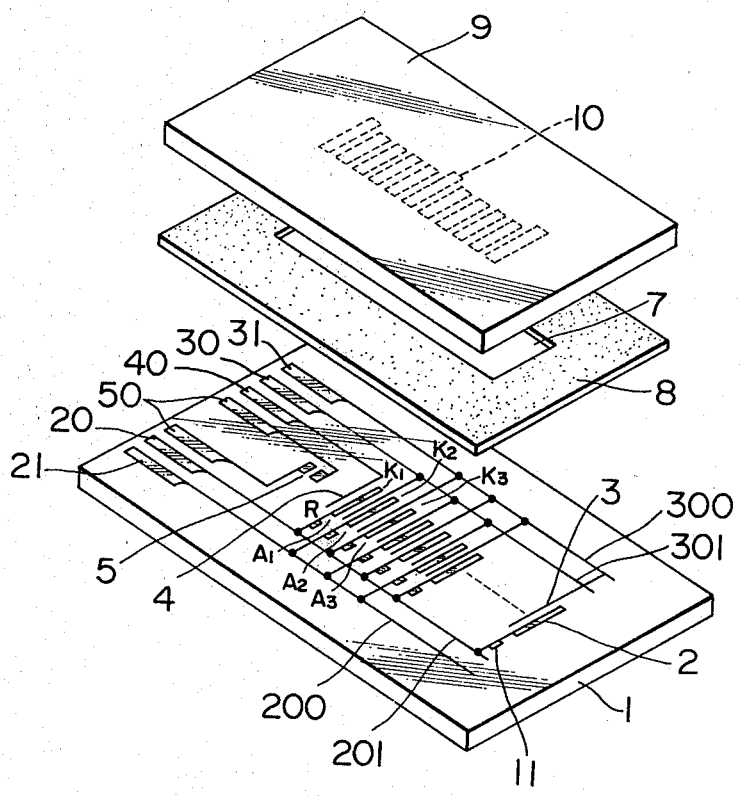
FIG. 3 and FIG. 4 show in exploded views bar-graph display devices of other embodiments of this invention.

The bar-graph display device according to this invention can have a memory function. FIG. 3 shows such an embodiment of this invention. This embodiment is the same as that shown in FIG. 2, except that every cathode is connected in series with a discharge current limiting resistor 11 (for a memory function) which is formed by the printing and firing of resistive paste. The memory function may also be effected by using the resistance of discharge itself between the anode and the cathode instead of the resistors 11.

With the resistors 11 or the intrinsic discharge resistances, the so-called memory function utilizing a bistable region existing between a discharge-starting voltage and the minimum discharge-maintaining voltage can be realized. This memory function provides a considerable merit that there are lessened requirements for achieving high brightness, high efficiency and long life-time, associated with the duty factor occurring in a cyclic-mode operation in the case of the absence of memory function.

In the above-described embodiments, the anodes and the cathodes have been formed on the same substrate with every anode spaced a distance from the adjacent cathode. In some cases, it is desirable to increase resolution by decreasing the space between the electrodes. An embodiment for such a purpose is shown in FIG. 4.

Figure 4:
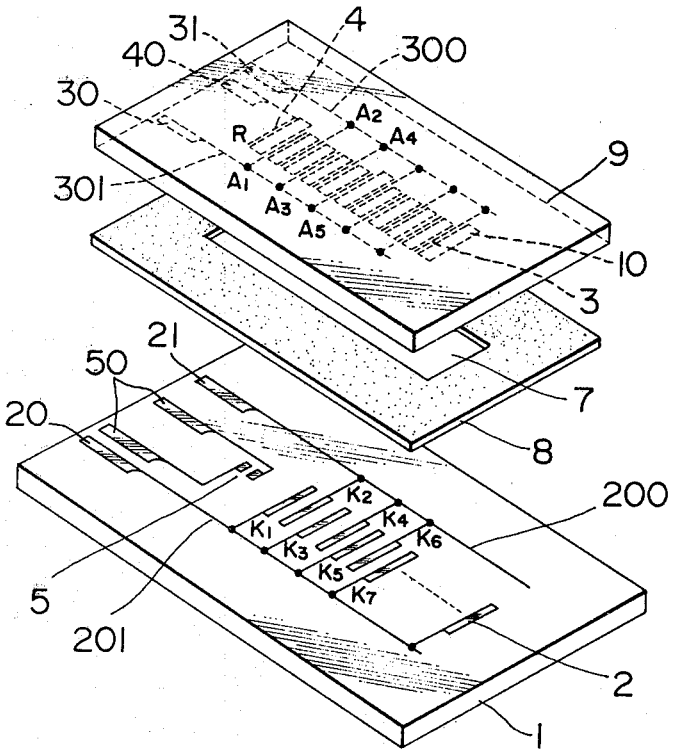

Referring to FIG. 4, anodes 3 are formed on the inner surface of a face plate 9 and arranged respectively opposite to cathodes 2 formed on the inner surface of a substrate 1. The anodes 3 may be arranged on those portions of the face plate 9 corresponding to the interspaces between the cathodes 2 on the substrate 1.

The embodiment shown in FIG. 4 has an advantage that multi-layering or multi-leveling process can be eliminated when the multi-phase connections are made for the anodes 3 and the cathodes 2. The other steps of the fabrication process are the same as those employed in the embodiment shown in FIG. 2.

Though the above embodiments have been shown with the two-phase anode and two-phase cathode arrangement, the multi-phase arrangement manner is not limited to the shown one. For example, a two-phase anode and three-phase cathode arrangement can be used.

What is claimed is:

1. A DC type gas discharge display device comprising a plurality of anodes on one surface of a substrate juxtaposed in a relationship spaced from each other, a plurality of cathodes disposed between said anodes, opposite to said anodes and in a relationship spaced therefrom so that said anodes and cathodes are alternately arranged on said one surface of said substrate to form a row in which said anodes alternate with said cathodes, first means for multi-phase connecting said anodes along said row, and second means for multi-phase connecting said cathodes along said row, whereby discharge produced between a selected one of said cathodes along said row and a selected one of anodes along said row is self-scanned in accordance with the multi-phase connections.

2. A gas discharge display device as claimed in claim 1, wherein each of said cathodes is provided with a resistor element connected in series therewith so that a voltage difference between a discharge-starting voltage and a minimum discharge-maintaining voltage developed by said resistor element provides a memory function.

3. A gas discharge device as claimed in claim 1 or 2, wherein the row of alternating anodes and cathodes forms a display row for a bar graph display.

4. A DC type gas discharge display device comprising first and second dielectric plates at least one of which is transparent, a plurality of anodes on one surface of said first plate juxtaposed in a relationship spaced from each other, a plurality of cathodes on said one surface of said first plate disposed between said anodes, opposite to said anodes and in a relationship spaced therefrom so that said anodes and cathodes are alternately arranged on said one surface of said first plate to form a row in which said anodes alternate with said cathodes, first means for multi-phase connecting said anodes along said row, second means for multi-phase connecting said cathodes along said row, insulating means inserted between said one surface of said first plate and said second plate to define a discharge space in which discharge between said anodes and cathodes is established, and discharge gas hermetically contained in said discharge space, wherein the discharge is self-scanned.

5. A gas discharge display device as claimed in claim 4, wherein said discharge gas includes mainly He with an addition of Xe.

6. A gas discharge device as claimed in claim 4, wherein each of said cathodes is provided with a resistor element connected in series therewith so that a voltage difference between a discharge-starting voltage and a minimum discharge-maintaining voltage developed by said resistor element provides a memory function.

* * * * *